US005826474A

United States Patent [19]

Howard et al.

[11] Patent Number: 5,826,474

[45] Date of Patent: Oct. 27, 1998

[54] TRIM STRIP DEFLECTOR

[75] Inventors: Linda A. Howard, Brookfield; Edward M. Ifkovits, New Fairfield, both of Conn.

[73] Assignee: Pitney Bowes Inc., Stamford, Conn.

[21] Appl. No.: 798,670

[22] Filed: Feb. 11, 1997

Related U.S. Application Data

[63] Continuation-in-part of Ser. No. 418,347, Apr. 7, 1995, abandoned.

[51] Int. Cl.[6] ..... B26D 1/03

[52] U.S. Cl. ..... 83/105; 83/408; 83/423; 83/856

[58] Field of Search ..... 83/423, 651.1, 83/105, 856, 408

[56] References Cited

U.S. PATENT DOCUMENTS

| | | | |
|---|---|---|---|
| 1,797,950 | 3/1931 | Forman | 83/408 |
| 2,252,734 | 8/1941 | Sherman | 83/408 |
| 2,399,154 | 4/1946 | Antrim et al. | 83/423 |
| 2,476,326 | 7/1949 | Sherman | 83/423 |
| 2,477,128 | 7/1949 | Hope, Jr. | 83/423 |
| 2,500,772 | 3/1950 | Reed | 83/105 |
| 2,788,853 | 4/1957 | Wurm et al. | 83/105 |
| 3,039,345 | 6/1962 | Euth | 83/423 |
| 3,056,324 | 10/1962 | Lach | 83/423 |
| 3,774,485 | 11/1973 | Kercher | 83/423 |
| 5,036,739 | 8/1991 | Clar | 83/856 |
| 5,235,882 | 8/1993 | Rabourn | 83/408 |
| 5,628,864 | 5/1997 | Kataigi et al. | 83/408 |

*Primary Examiner*—Kenneth E. Peterson
*Attorney, Agent, or Firm*—Christopher J. Capelli; Melvin J. Scolnick

[57] ABSTRACT

Apparatus for dividing a continuous web having perforated, marginal strips on its sides into discrete sheets and removing the marginal strips. The apparatus includes: a device for engaging and moving the perforated, marginal strips of the continuous web along a feed path; a slitting device located downstream of the engaging and moving device for separating the marginal strips from the remaining, central portion of the web; a cutting device for dividing the remaining, central portion of the web into discrete sheets; a pair of deflectors located downstream of the cutting device for advancing the remaining, central portion of the web and for guiding the severed, marginal portions below the feed path.

5 Claims, 4 Drawing Sheets

TRIM STRIP DEFLECTOR

BACKGROUND OF THE INVENTION

This application is a continuation-in-part of application Ser. No. 08/418,347 filed Apr. 7, 1995, now abandoned.

The instant invention relates to paper cutting and trimming, and more particularly, to apparatus for deflecting a marginal strip once it has been severed from a sheet of paper having a marginal traction area.

In printing duplicate forms, such as checks, utility bills, sales slips, invoices, etc., it is more economical to print successive impressions on continuous webs of material in longitudinally spaced series connected relation and subsequently sever the web intermediate succeeding impressions into individual sheets, slips or forms.

It is common practice to progressively advance a continuous web of record material through imprinting apparatus wherein information is recorded thereon at longitudinally spaced intervals. In order that successive recorded information may be disposed within prescribed areas or in predetermined relation with successive portions of the webs, the latter are provided with marginal traction areas having therein punched holes, notches or other configurations for engagement of traveling pin type or other form of positive web feeding device.

To facilitate subsequent division of a record web into succession of individual sheets, the web is ordinarily provided with longitudinally spaced, transverse scored or weakened lines intermediate succeeding record receiving areas. Such transverse weakened lines are formed in the web at the time the succeeding forms thereon are printed, or subsequent thereto, as most convenient, preparatory to separation at uniformly spaced intervals into individual sheets subsequent to receiving inscriptions thereon. If such traverse lines of weakening are not provided, then a knife is employed to cut the web into individual sheets.

The web is generally provided with longitudinal, weakened lines upon which the marginal traction areas thereof are also separable. A knife or blade is employed to separate the marginal traction area (trim strip) from the individual sheet. Presently, the prior art teaches the use of a pair of rollers to guide the severed trim strip down and away from the remaining individual sheet. However, a severed trim strip is much like a wet noodle, and pushing it into a pair of rollers in not easily achieved on a reliable and consistent basis.

Accordingly, the instant invention provides apparatus which assures that the severed trim strip can be reliably and consistently moved away from the individual sheet of paper without causing any jams in the trim strip removal apparatus.

SUMMARY OF THE INVENTION

Accordingly, the instant invention provides apparatus for dividing a continuous web having perforated, marginal strips on its sides into discrete sheets and removing said marginal strips. The apparatus comprises: means for engaging and moving the perforated, marginal strips of said continuous web along a feed path; slitting means located downstream of said engaging and moving means for separating said marginal strips from the remaining, central portion of said web; cutting means for dividing the remaining, central portion of said web into discrete sheets; a pair of deflectors located downstream of said cutting means for advancing said remaining, central portion of said web and for guiding said severed, marginal portions below said feed path, each of said deflectors having an upstream, horizontal leg, a downstream, angled leg forming an obtuse angle with said horizontal leg.

DETAILED DESCRIPTION OF THE PREFERRED EMBODIMENT

Figure 2:
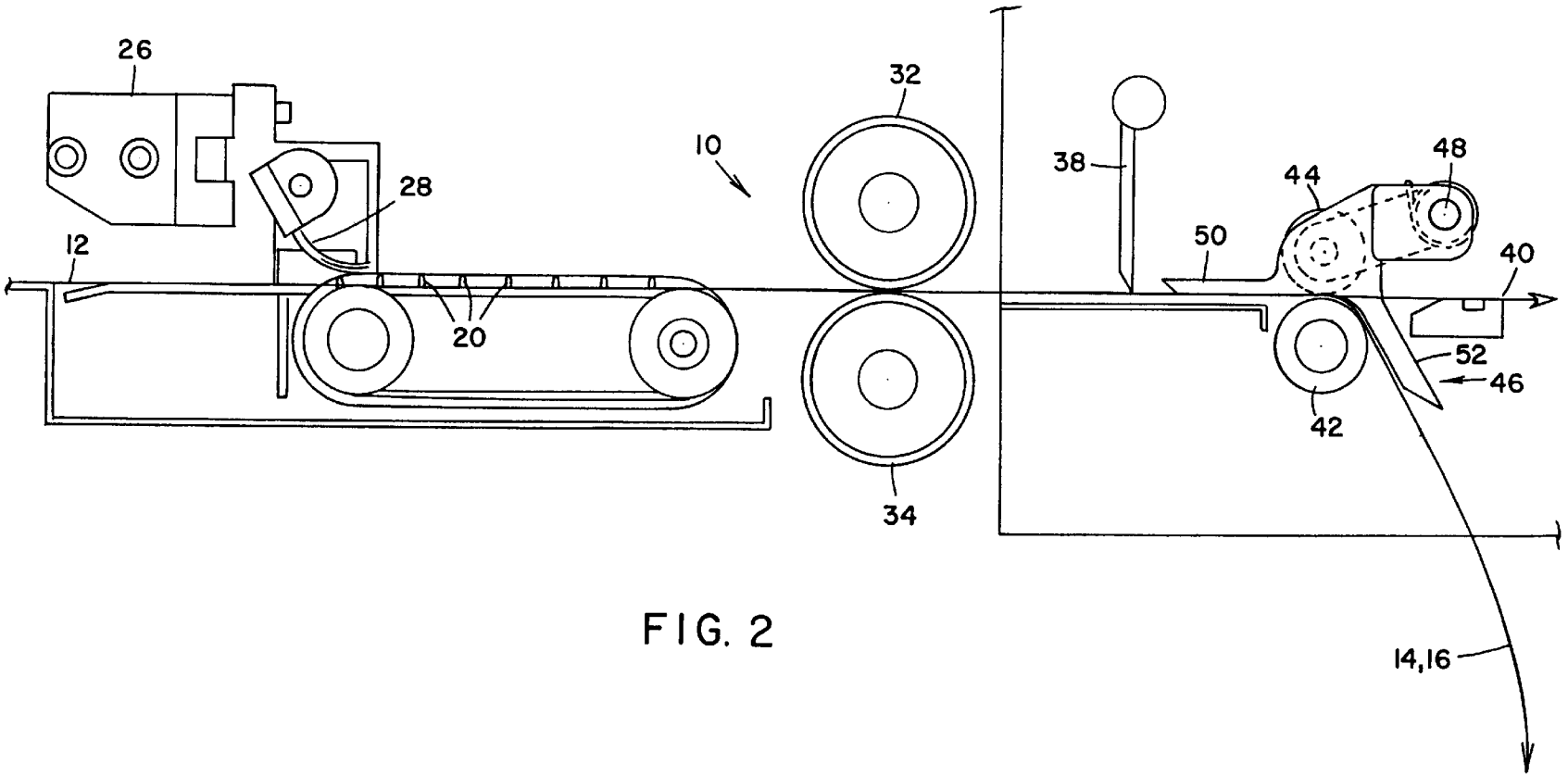
FIG. 2 is a side, elevational view of the apparatus seen in FIG. 1.

In describing the preferred embodiment of the instant invention, reference is made to the drawings, wherein there is seen in FIG. 2 a web cutting and trim stripping device generally designated 10 which processes a continuous web of paper 12 (see FIG. 2) having a pair of perforated margin strips 14 and 16. Each of the margin strips 14 and 16 includes a plurality of linear, uniformly spaced apertures 18 which engage the pins 20 of a pair of toothed, timing belts 22 and 24. The web 12 is fed to the toothed, timing belts 22 and 24 from upstream apparatus (not shown) which would typically include a printer, and past a scanner 26. A brush 28 extends from the scanner 26 and guides the web 12 onto the toothed belts 22 and 24.

Figure 1:
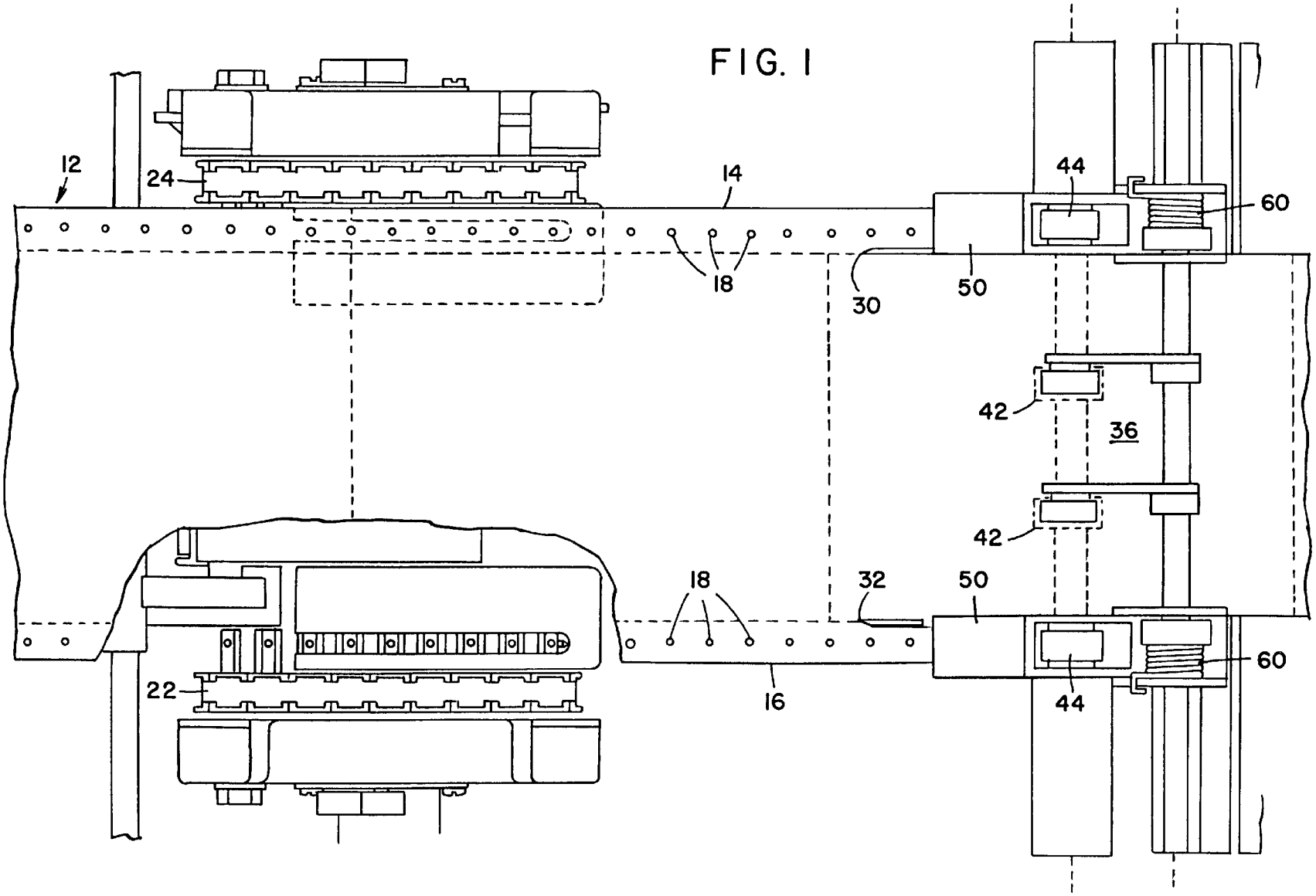
FIG. 1 is a top, plan view of trim strip deflecting apparatus in accordance with the instant invention.
Figure 4:
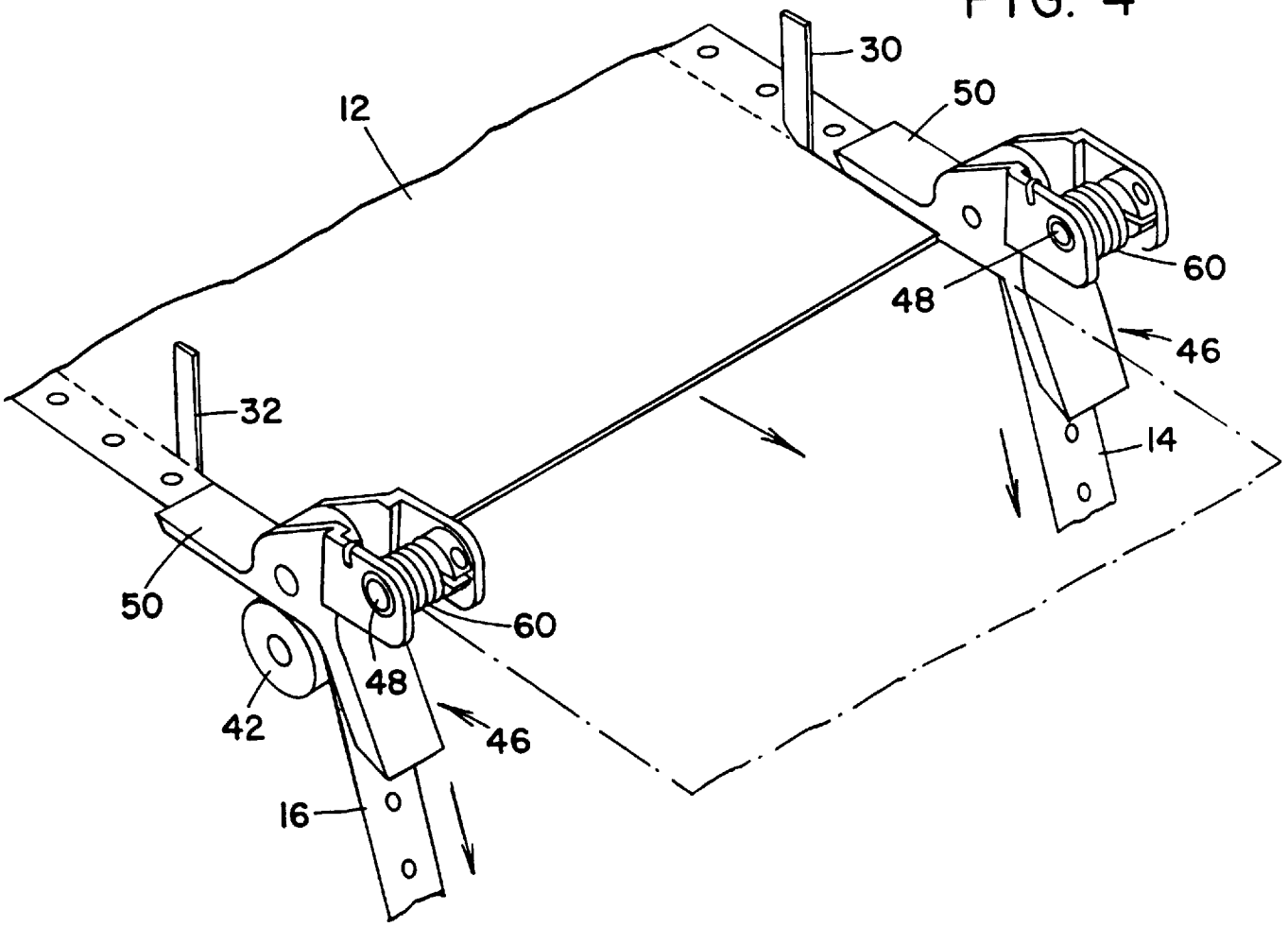
FIG. 4 is a perspective view of the trim strip seen in FIG. 1 being deflected downward.

The belts 22 and 24 then feed the web 12 past a pair of conventional, stationary slitter knives 30 and 32 and cooperating rollers 34. The slitter knives 30 and 32 cause the margin strips 14 and 16 to be severed from the web 12, as best seen in FIG. 1. The severed margin strips 14 and 16 and the remaining central portion 36 of the web 12 are then driven by the belts 22 and 24 toward a reciprocating knife 38 (see FIG. 2) and a pair of outer and inner drive rollers 42 and 42' and a pair of outer and inner driven rollers 44 and 44'. As best shown in FIG. 4, the pair of outer drive rollers 42 cooperate with the pair of inner driven rollers 44 to advance the severed margin strips 14,16, while the pair of inner drive rollers 42' cooperate with the pair of inner driven rollers 44' to advance the central portion 36 of the web 12. Once the central portion 36 of the web 12 and the severed margin strips 14 and 16 are respectively gripped by the inner and outer drive rollers 42', 42 and driven rollers 44', 44 the reciprocating knife 38 is lowered to cut the central web portion 36 laterally into individual, discrete sheets of paper 40.

Figure 3:
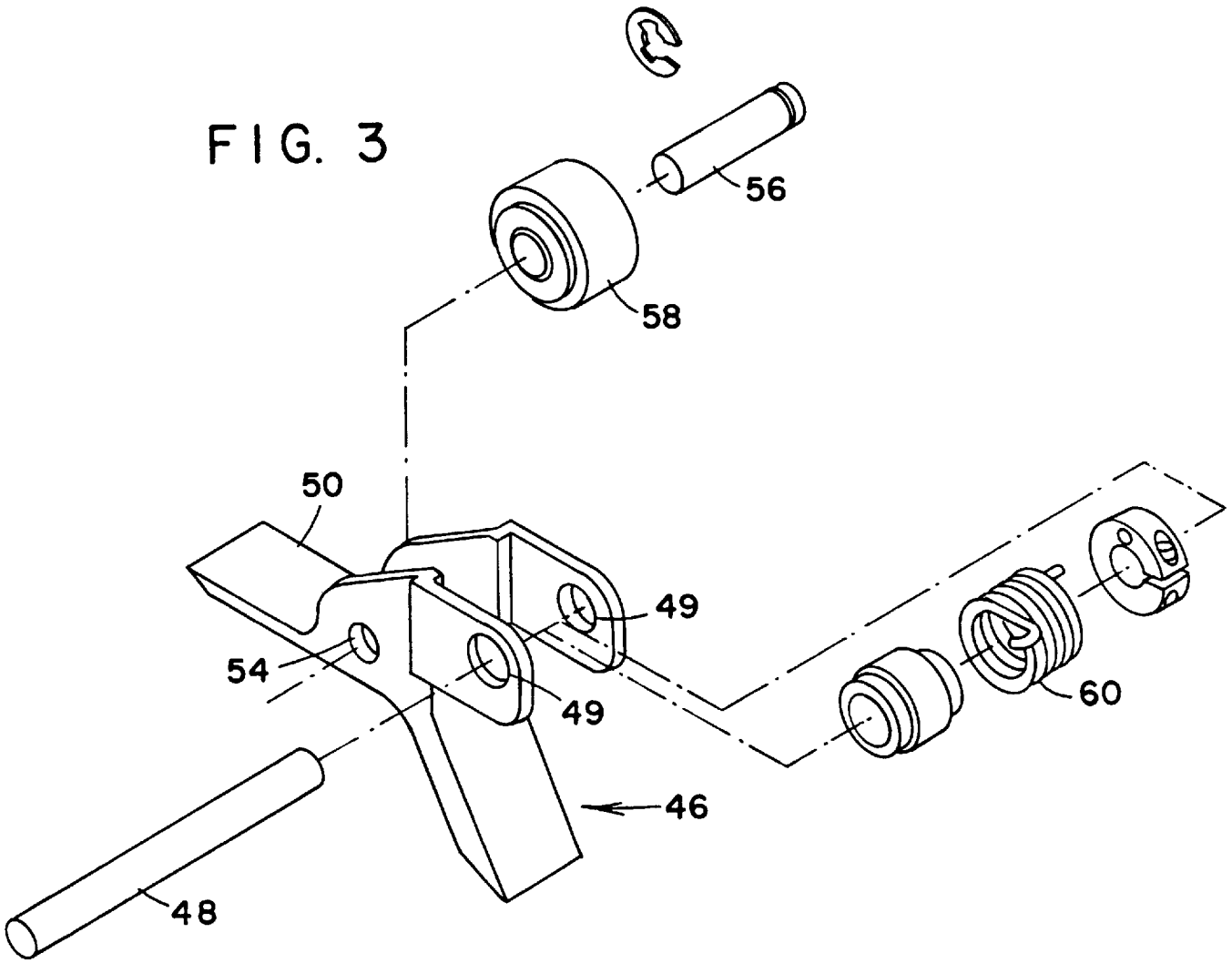
FIG. 3 is an exploded, perspective view of the strip deflector seen in FIGS. 1 and 2.

Each of the outer driven rollers 44 is mounted in a trim strip deflector generally designated 46. Each of the deflectors 46 is rotatably mounted through openings 49 onto an elongate fixed shaft 48 (see FIG. 3), which extends between the two deflectors 46. Each deflector 46 includes a horizontal leg 50 and an angled leg 52 which forms an obtuse angle with the horizontal leg 50 on the downstream end of the horizontal leg 50. Each of the horizontal legs 50 includes an aperture 54 which receives a shaft 56 on which the outer driven roller 44 is rotatably mounted. A coil spring 60 is mounted on each end of the elongate shaft 48, which spring 60 functions to bias each deflector 46 in a counter-clockwise direction so that the outer and inner driven rollers 44, 44' are biased downwardly onto the severed margin strips 14, 16 and the central portion 36 of the web 12, respectively. Each horizontal leg 50 of each deflector 46 is formed with a cutout portion 47 (FIG. 2) through which extends an outer periphery portion of an outer drive roller 44, enabling the outer drive roller 44 to come into engagement with a perforated marginal strip 14, 16.

As best shown in FIG. 4, the pair of outer and inner drive rollers 42, 42' are received about drive shaft 43, whereby rotation of shaft 43 causes corresponding rotation of the outer and inner drive rollers 42, 42'. The pair of inner drive rollers 44' extend from elongate shaft 48, via link members 45. Each link member 45 has one end connected to a hub 47, which is received about elongate shaft 48, and the opposing end is rotatably connected to a driven roller 44'. Through the biasing action of the coil springs 60, the inner driven rollers 44' are biased downwardly against the central portion 36 of the web 12, thereby forcing the central portion 36 to engage with the inner drive rollers 42' so as to cause its advancement past the deflectors 46 for further processing.

Once the margin strips 14 and 16 are severed by the slitter knives 30 and 32, the strips 14 and 16 continue to be fed by the pins 20 of the belts 22 and 24 under the horizontal legs 50 of the deflectors 46 and into the nip of the outer drive rollers 42 and driven rollers 44. The angled legs 52 of the deflectors 46 force the margin strips 14 and 16 downward away from the remaining, discrete sheets of paper 40 to an area where the strips 14 and 16 can be removed as scrap paper. The discrete sheets of paper 40 are fed away from the deflectors 46 by the inner rollers 42' and 44' and ultimately are engaged by additional paper handling apparatus downstream for further processing, such as collating, folding, and inserting into an envelope.

As best seen in FIG. 2, the horizontal legs 50 of the deflectors 46 are adjacent but spaced from the reciprocating knife 38 and in effect bridge the gap between the knife 38 and the pair of outer rollers 42 and 44. It is important to locate the horizontal legs 50 of the deflectors 46 as close to the knife 38 as reasonably possible in order to minimize the wet noodle effect which comes about when the marginal strips 14 and 16 are severed by the slitter knives 30 and 32 respectively. The preferred distance between the deflector legs 50 and the knife 38 is about ⅝", and a preferred range for this distance would be between ¼ and ⅜ inch. By locating the horizontal legs 50 this close to the knife 38, it can be seen that the marginal strips 14 and 16 are under maximum possible control and thus are more uniformly and consistently fed into the outer rollers 42 and 44. Thus, jams occurring due to the marginal strips 14 and 16 being misfed are virtually eliminated.

It should be understood by those skilled in the art that various modifications may be made in the present invention without departing from the spirit and scope thereof, as described in the specification and defined in the appended claims.

What is claimed is:

1. Apparatus for dividing a continuous web having a central portion and side portions adjacent said central portion, said side portions having perforated, marginal strips, into discrete sheets and removing said marginal strips, comprising:

a pair of timing belts having a plurality of teeth for engaging and moving the perforated, marginal strips of the continuous web along a feed path;

a pair of stationary, slitter knives located downstream of the engaging and moving means for separating the marginal strips from the central portion of the web;

cutting means for dividing the central portion of the web into discrete sheets;

at least one inner drive roller mounted below the central portion of the web along the feed path;

a pair of deflectors located downstream of the cutting means for advancing the central portion of the web and for guiding the severed, marginal portions below the feed path, each of the deflectors having an upstream, horizontal leg, a downstream, angled leg forming an obtuse angle with the horizontal leg and extending below the feed path, and an outer driven roller engaging the feed path;

a pair of outer drive rollers located beneath the outer driven rollers, wherein each outer drive roller and each outer driven roller engages the marginal strip, wherein the severed, marginal strips are guided along and under the horizontal legs of the deflectors, between the outer drive rollers and the outer driven rollers of the deflectors and along the angled legs of the deflectors; and at least one inner drive roller located beneath the inner driven roller, wherein the at one inner drive and driven roller engage the central portion of the web, whereby the associated discrete sheets of the central portion of the web are conveyed along the feed path and away from the deflectors.

2. The apparatus of claim 1, wherein the cutting means comprises a reciprocating knife.

3. The apparatus of claim 2, wherein the distance between the horizontal legs of the deflectors and the reciprocating knife is between about ¼ and ⅜ inch.

4. The apparatus of claim 3, wherein the distance is about 5/16 inch.

5. The apparatus of claim 4, additionally comprising means for biasing each of the outer and inner driven rollers downwardly.

* * * * *